US011346515B1

(12) United States Patent
Yang et al.

(10) Patent No.: US 11,346,515 B1
(45) Date of Patent: May 31, 2022

(54) LED TROFFER ASSEMBLY

(71) Applicant: LONGHORN INTELLIGENT TECH CO., LTD, Shenzhen (CN)

(72) Inventors: Haitao Yang, Shenzhen (CN); Lin Yang, Shenzhen (CN); Xingwei Huang, Shenzhen (CN); Julong Zheng, Shenzhen (CN)

( * ) Notice: Subject to any disclaimer, the term of this patent is extended or adjusted under 35 U.S.C. 154(b) by 0 days.

(21) Appl. No.: 17/326,798

(22) Filed: May 21, 2021

(51) Int. Cl.

| | |
|---|---|
| ***F21S 8/04*** | (2006.01) |
| ***F21V 17/18*** | (2006.01) |
| ***F21V 21/04*** | (2006.01) |
| ***F21Y 115/10*** | (2016.01) |

(52) U.S. Cl.
CPC ..... *F21S 8/043* (2013.01); *F21V 17/18* (2013.01); *F21V 21/048* (2013.01); *F21Y 2115/10* (2016.08)

(58) Field of Classification Search
CPC ... F21S 8/043; F21S 8/04; F21S 8/026; F21V 17/18; F21V 21/048; F21V 21/02; F21Y 2115/10; F21Y 2105/00
See application file for complete search history.

(56) References Cited

U.S. PATENT DOCUMENTS

| | | | | |
|---|---|---|---|---|
| 8,523,383 | B1 | 9/2013 | Grigore et al. | |
| 9,182,091 | B2 | 11/2015 | Gershaw | |
| 9,671,095 | B1 * | 6/2017 | Sorensen | F21S 8/026 |
| 9,874,320 | B2 | 1/2018 | Price et al. | |
| 10,012,352 | B2 | 7/2018 | Scribante et al. | |
| 10,174,915 | B2 | 1/2019 | Scribante et al. | |
| 10,274,171 | B2 | 4/2019 | Goelz et al. | |
| 10,488,023 | B1 * | 11/2019 | Rao | F21V 21/048 |
| 11,209,590 | B1 * | 12/2021 | Wang-Munson | F21S 8/026 |
| 2020/0370737 | A1 * | 11/2020 | Yang | F21S 8/026 |

* cited by examiner

*Primary Examiner* — Peggy A Neils
(74) *Attorney, Agent, or Firm* — Clement Cheng

(57) ABSTRACT

A light troffer assembly has a cover panel. A T-bar frame has a right T-bar parallel to a left T-bar, and with a rear T-bar parallel to a front T-bar. A bracket frame is mounted between the cover panel and the T-bar frame. The bracket frame includes a first mounting bracket mounted above the right T-bar, a second mounting bracket mounted above the left T-bar, and a first mounting rail and a second mounting rail connecting the first mounting bracket to the second mounting bracket. The mounting bracket frame is sandwiched between the cover panel and the T-bar frame. An LED panel has an LED panel power supply, pivot hook latches and pivot pins.

18 Claims, 5 Drawing Sheets

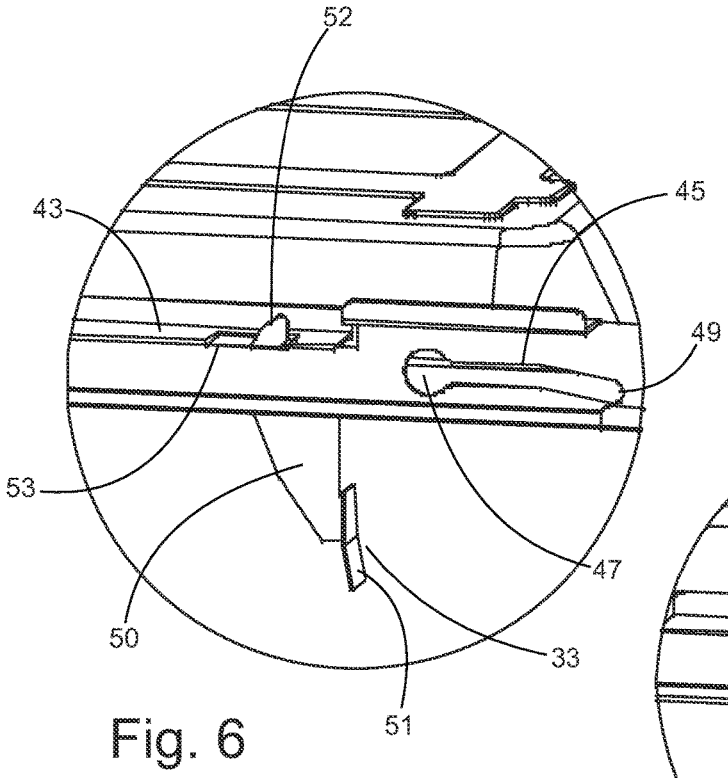
Fig. 6
Fig. 7
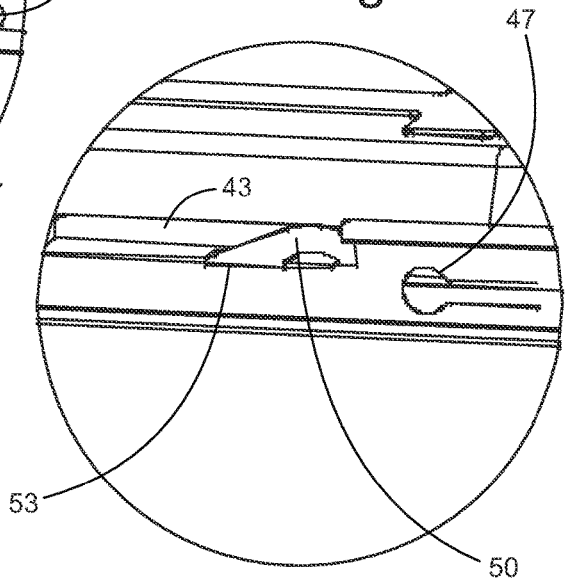
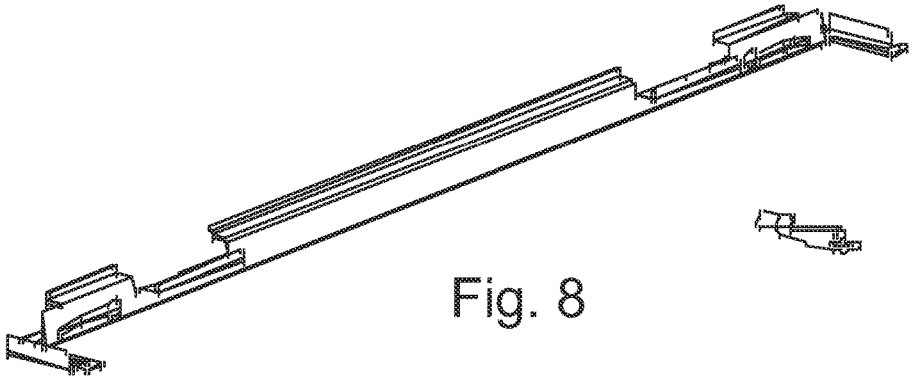
Fig. 8

LED TROFFER ASSEMBLY

FIELD OF THE INVENTION

The present invention is in the field of LED lighting assemblies.

DISCUSSION OF RELATED ART

A variety of different overhead lighting troffer connection assemblies have been described in prior art. For example, in U.S. Pat. No. 10,274,171B2 Adjustable LED Light Fixture For Use In A Troffer by inventor Dave Goelz et al. published on Apr. 30, 2019, the abstract discloses, "The light fixture is configured to be mounted in a troffer. The light fixture includes a light emitting assembly including at least one LED and a reflector assembly. A mechanical attachment mechanism is configured to be connected directly between the light fixture and a troffer. The mechanical attachment mechanism is adjustable such that a distance between the light fixture and the troffer may vary. The mechanical attachment mechanism may comprise at least one bracket pivotably connected to the light fixture, a cable having an attachment structure wherein the effective length of the cable is adjustable, a telescoping bracket having an attachment structure wherein the effective length of the telescoping bracket is adjustable, a threaded member having an attachment structure wherein the effective length of the threaded member is adjustable by a threaded nut that engages the threaded member. The mechanical attachment mechanism positively secures the light fixture to the troffer without gaps to create an electrical enclose that prevents risk of fire or shock."

For example, in U.S. Pat. No. 10,174,915B2 Troffer Light Fixture Retrofit Systems and Methods by inventor John Scribante et al. published Jan. 8, 2019 the abstract discloses, "A retrofitting kit for retrofitting an existing troffer light fixture having a troffer housing includes a door assembly and a retainer including a flange. The flange is deformable between a first position and a second position. The light source is within the housing. The retainer includes the flange coupled to the housing of the door assembly. The retainer is configured to engage at least one of the troffer housing and a T-bar of a ceiling system to thereby selectively secure the door assembly within the ceiling system when the flange is in the first position. The retainer is further configured to facilitate at least one of installation and removal of the door assembly when the flange is in the second position."

For example, in U.S. Pat. No. 10,012,352B2 Troffer Light Fixture Retrofit Systems and Methods by inventor John Scribante et al. published Jul. 3, 2018 the abstract discloses, "A retrofitting kit for retrofitting an existing troffer light fixture having a troffer housing includes an adaptor bracket and a door assembly. The adaptor bracket includes a channel configured to rest on a T-bar of a ceiling system, and further configured to be located between the T-bar and the troffer housing. The channel defines an aperture configured to accept either a hinge or a latch of the door assembly, and the channel defines a latch surface. The door assembly includes a hinge configured to interface with the adaptor bracket, a latch configured to engage the latch surface of the adaptor bracket to hold the door assembly in a closed position, a housing including the latch and the hinge, and a light source coupled to the housing."

For example, in United States patent number Retrofit Kit for Drop Ceiling Lighting Fixtures by inventor Russell A. Price published Jan. 23, 2018 the abstract discloses, "A retrofit kit for drop ceiling lighting fixtures and a method of retrofitting drop ceiling lighting fixtures are provided. The retrofit kit includes a pair of adapter brackets configured to be mounted to opposing sides of a drop ceiling fixture, and a door-light assembly configured to be pivotally coupled to one adapter bracket, and to be latched to the other adapter bracket."

For example, in U.S. Pat. No. 9,182,091B2 LED Panel Light Fixture by inventor David Gershaw published Nov. 10, 2015 the abstract discloses, "Devices, systems, and methods are provided for both retrofitting existing lighting fixtures with LED panels and for installing ceiling tiles having LED modules incorporated therewith. In one exemplary embodiment, a thin panel includes an LED module integrated therewith and the panel is disposed over an opening in a troffer to provide light from the panel-module combination. In another exemplary embodiment, a ceiling tile includes an LED module integrated therewith and the tile is placed in a ceiling grid so light can be provided from that tile. Exemplary configurations of the systems, devices, and kits, as well as methods for installing the same, are also provided."

For example, in U.S. Pat. No. 8,523,383B1 Retrofitting Recessed Lighting Fixtures by inventor Valerica Grigore et al., published Sep. 3, 2013 the abstract discloses, "A retrofit kit assembly for a recessed lighting fixture and methods for manufacturing and installing the same are described herein. The retrofit kit includes at least two mounting brackets, which can each include at least one lamp socket. The kit also includes at least one ballast, which may be pre-wired to the sockets. Each ballast may include a temporary adhesive on a mounting side thereof, for use during the installation process. For example, the installer may provisionally mount the ballast to an interior surface of an existing housing of the fixture and then permanently mount the ballast using one or more fasteners. The mounting brackets and ballast of the kit may include captive hardware which is held in place in the aperture for the fastener prior to fastening the particular object to the recessed housing, which reduces risk of dropping or losing fasteners during installation."

SUMMARY OF THE INVENTION

A light troffer assembly has a cover panel. A T-bar frame has a right T-bar parallel to a left T-bar, and with a rear T-bar parallel to a front T-bar. A bracket frame is mounted between the cover panel and the T-bar frame. The bracket frame includes a first mounting bracket mounted above the right T-bar, a second mounting bracket mounted above the left T-bar, and a first mounting rail and a second mounting rail connecting the first mounting bracket to the second mounting bracket. The mounting bracket frame is sandwiched between the cover panel and the T-bar frame. An LED panel has an LED panel power supply, pivot hook latches and pivot pins.

A pair of first mounting bracket panel stops are formed on the first mounting bracket and a pair of second mounting bracket panel stops are formed on the second mounting bracket. The pivot pins engage pivot pin openings on the first mounting rail and the second mounting rail. Pivot hook latches engage one of the first mounting bracket pivot hook openings and one of the second mounting bracket panel pivot hook openings when the LED panel swings from a vertical disengaged position to a horizontal engaged position.

A panel slot cut out is formed adjacent to a panel stop bend. The panel stop is bent towards the LED panel. Panel pivot pin heads are formed on the pivot pins. The first mounting panel pivot hook openings and the second mounting panel pivot hook openings are configured to provide reversible installation of the LED panel. The panel stops are folded at panel stop bends, and the panel stops are folded toward the LED panel.

The first mounting bracket and the second mounting bracket have a mounting bracket main section and a pair of mounting bracket extensions that extends at a 90° angle from the mounting bracket main section. The panel stops have a planar section with an upward extending lip. The panel stops abut an upper surface of the LED panel when the LED panel is rotated to an engaged horizontal position from a disengaged vertical position. The panel stop cut out is rectangular and elongated. The panel stop cut outs and the panel stop bends are parallel to the retainer slots. The panel stop cut outs are rectangular and elongated. The pair of first mounting bracket panel stops and the pair of second mounting bracket panel stops are configured to provide reversible installation of the LED panel.

BRIEF DESCRIPTION OF THE DRAWINGS

FIG. 6 is a close-up view of the pivot hook body.

FIG. 7 is a close-up view of the pivot hook body being engaged.

FIG. 8 is an isolated view of the mounting bracket.

Figure 1:
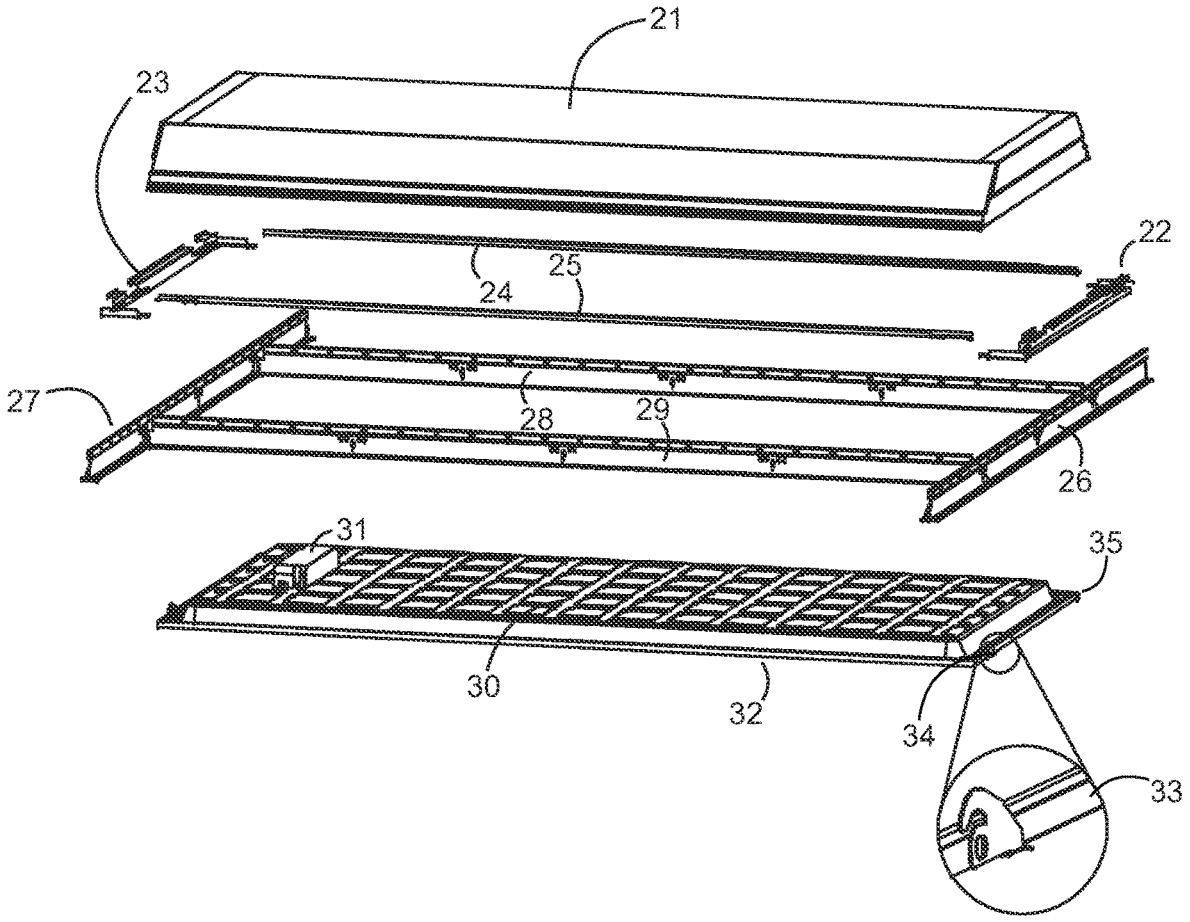
FIG. 1 is an exploded view of the present invention.

The following call out list of elements can be a useful guide in referencing the element numbers of the drawings.

21 cover panel
22 first mounting bracket
23 second mounting bracket
24 first mounting rail
25 second mounting rail
26 right T-bar
27 left T-bar
28 rear T-bar
29 front T-bar
30 LED panel
31 power supply
32 LED lamp
33 pivot hook latch
34 pivot hook
35 hanging pivot axle
36 bracket frame
37 T-bar frame
40 mounting bracket frame
41 mounting bracket main section
141 mounting bracket extension
41 panel stop bend
43 panel stop
44 panel slot cut out
45 retainer slot
46 panel pivot pin
47 panel pivot pin opening
48 panel pivot pin head
49 retainer slot low side

DETAILED DESCRIPTION OF THE PREFERRED EMBODIMENT

FIG. 1 is an exploded view of the present invention. The assembly has a cover panel 21. The cover panel is mounted above the T track frame. The T-bar frame includes a right T-bar 26 parallel to a left T-bar 27, with a rear T-bar 28 parallel to a front T-bar 29. The T-bar frame supports the mounting bracket frame, and the LED panel 30 is mounted to the bracket frame. Generally, a pair of hanging pivot axles 35 extend from the LED panel 30, which engage to the mounting brackets. Pivot hooks 34 are mounted on a left and right side of the LED panel 30.

The cover panel rests on a mounting bracket frame which includes a first mounting bracket 22 mounted parallel to a second mounting bracket 23, with a first mounting rail 24 parallel to a second mounting rail 25. The first mounting bracket fits above the right T-bar 26, and the second mounting bracket 23 mounts to the left T-bar 27. Similarly, the rear T-bar 28 supports the first mounting rail 24, and the front T-bar 29 supports the second mounting rail. The first mounting bracket 22 connects to the first mounting rail 24 which connects to the second mounting bracket 23 which connects to the second mounting rail 25, which connects to the first mounting bracket 22. Therefore, the mounting bracket frame is sandwiched between the cover panel and the T-bar frame.

The LED panel 30 is mounted to the bracket frame. The LED panel 30 includes a panel lamp 32 powered by a power supply 31. A pair of pivot hook latches 33 have a pair of a pivot hooks 34 that engages to the mounting bracket frame at the first mounting bracket and the second mounting bracket.

Figure 2:
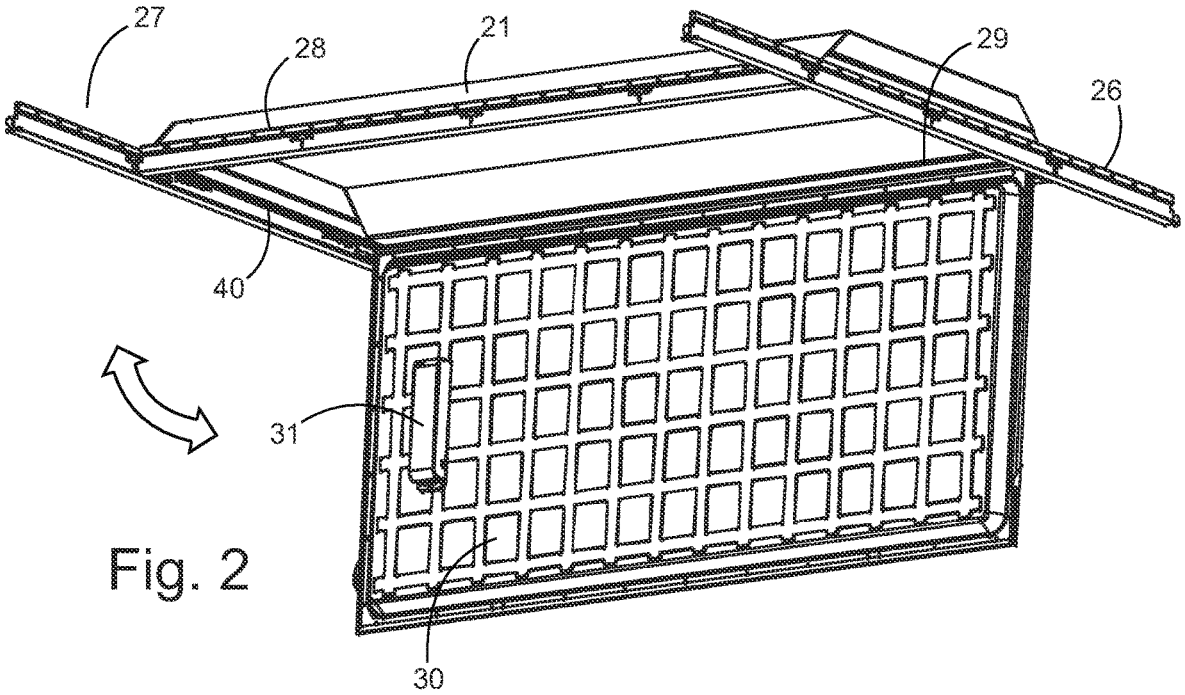
FIG. 2 is an assembly view of the present invention.

As seen in FIG. 2, the LED panel is installed to the mounting bracket frame at the panel pivot pin which allows the LED panel to swing freely in a detached position. The electrical connection from the power supply 31 to the cover panel 21 can be secured and then the LED panel 30 can be installed by rotating the LED panel from the vertical position to the horizontal position. The hanging pivot axles 35 can be formed as panel pivot pins 46 having panel pivot pin heads 48.

Figure 3:
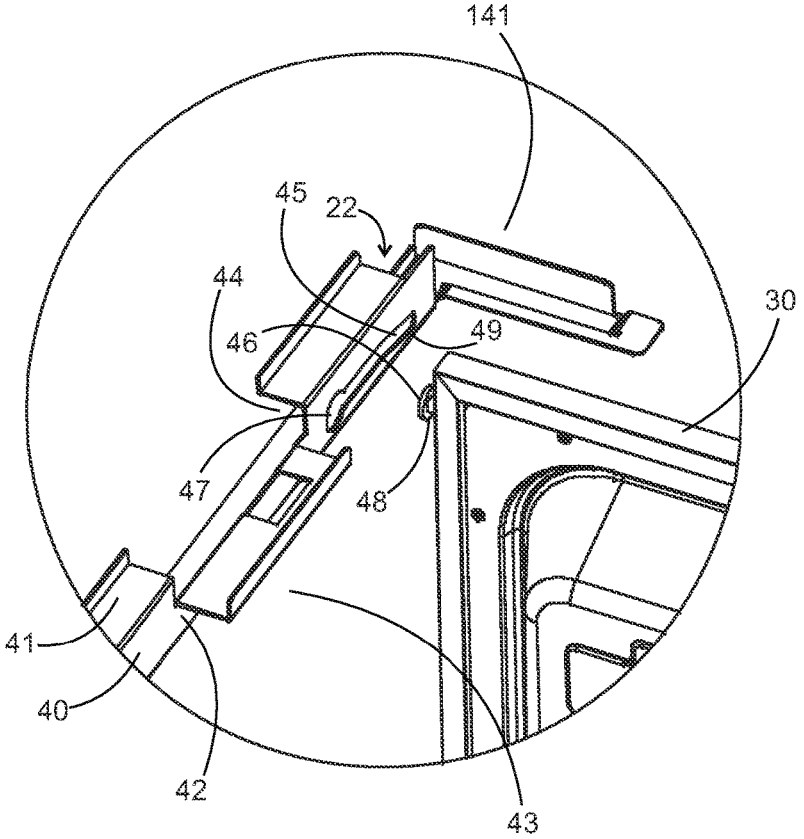
FIG. 3 is a close-up view of the assembly of the present invention.

As seen in FIG. 3, the LED panel 30 has a panel pivot pin 46 extending laterally from the LED panel 30. The panel pivot pin 46 is rigidly attached and has a preferably cylindrical body. The panel pivot pin 46 extends into a retainer slot 45. The retainer slot includes a panel pivot pin opening 47. The panel pivot pin 46 inserts into the panel pivot pin opening. The panel pivot pin has a panel pivot pin head 48 that has a larger diameter than the panel pivot pin body. The panel pivot pin head 48 enters the retainer slot 45 at the panel pivot pin opening 47 of the retainer slot 45 and slides downwardly to the retainer slot low side 49.

The mounting bracket frame 40 has a mounting bracket main section 41 and a mounting bracket extension 141. The mounting bracket extension 141 extends at a 90° angle from the mounting bracket main section 41. The mounting bracket extension 141 has a connector to adjacent portions of the mounting bracket frame 40.

The panel stop 43 is formed from the mounting bracket frame 40 at a fold in the bracket frame metal at a panel stop bend 42. The panel stop 43 can be cut from the mounting bracket frame 40 which creates a panel stop cut out 44. The panel stop cut out is an indented portion in the mounting bracket frame 40. The panel stop cut out is formed when the portion of material that is folded from the mounting bracket frame 40 forms the panel stop 43.

The panel stop 43 preferably has a planar section with an upward extending lip. The panel stop abuts the upper surface of the LED panel 30 when the LED panel 30 is rotated to the engaged horizontal position from the disengaged vertical position. The panel stop cut out 44 is preferably rectangular and elongated. The panel stop cut out 44 and the panel stop bend 42 are parallel to the retainer slot 45.

Figure 4:
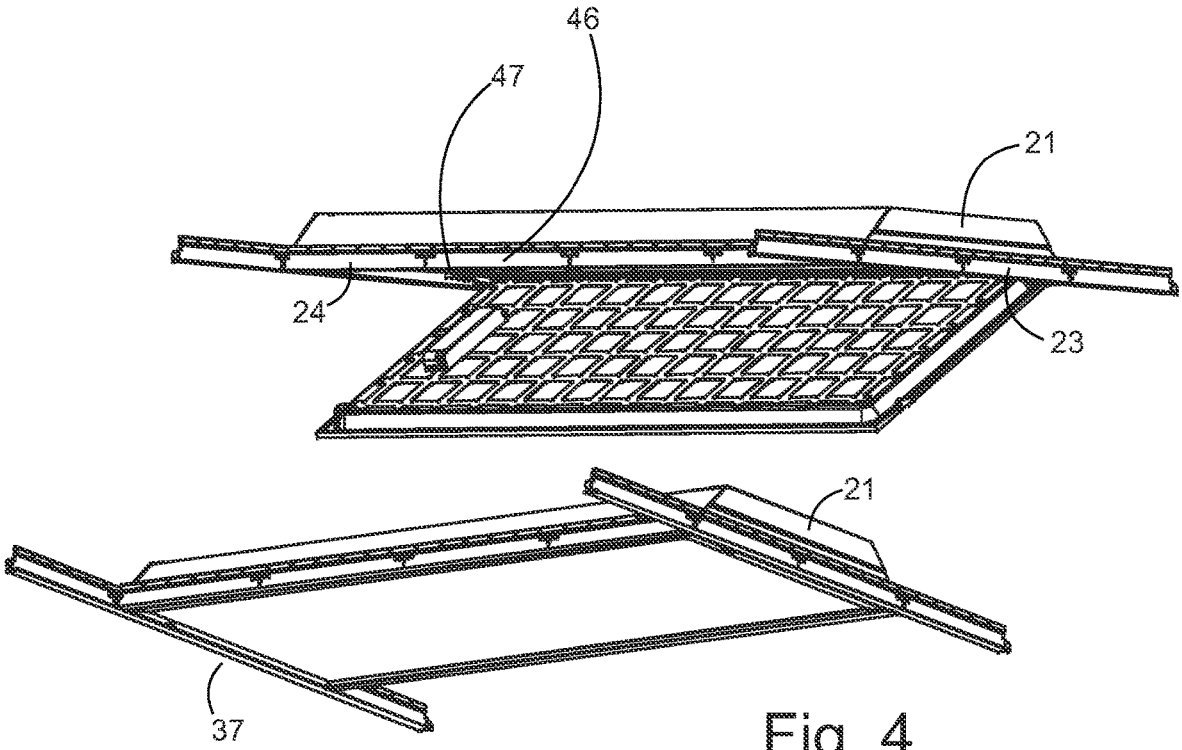
FIG. 4 is a diagram showing installation of the panel.
Figure 5:
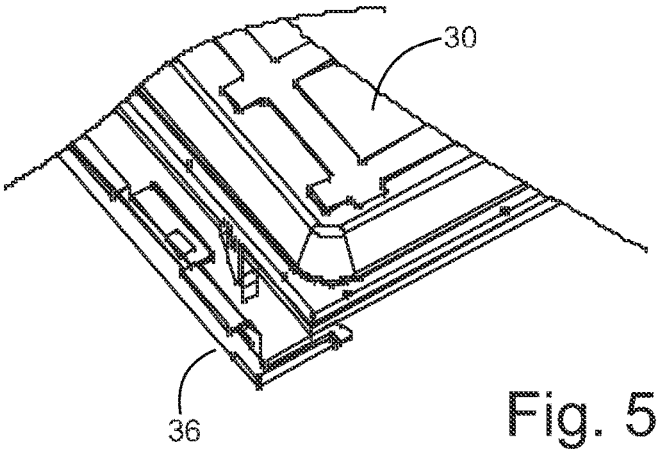
FIG. 5 is a close-up view of the mounting bracket connection area.
Figure 9:
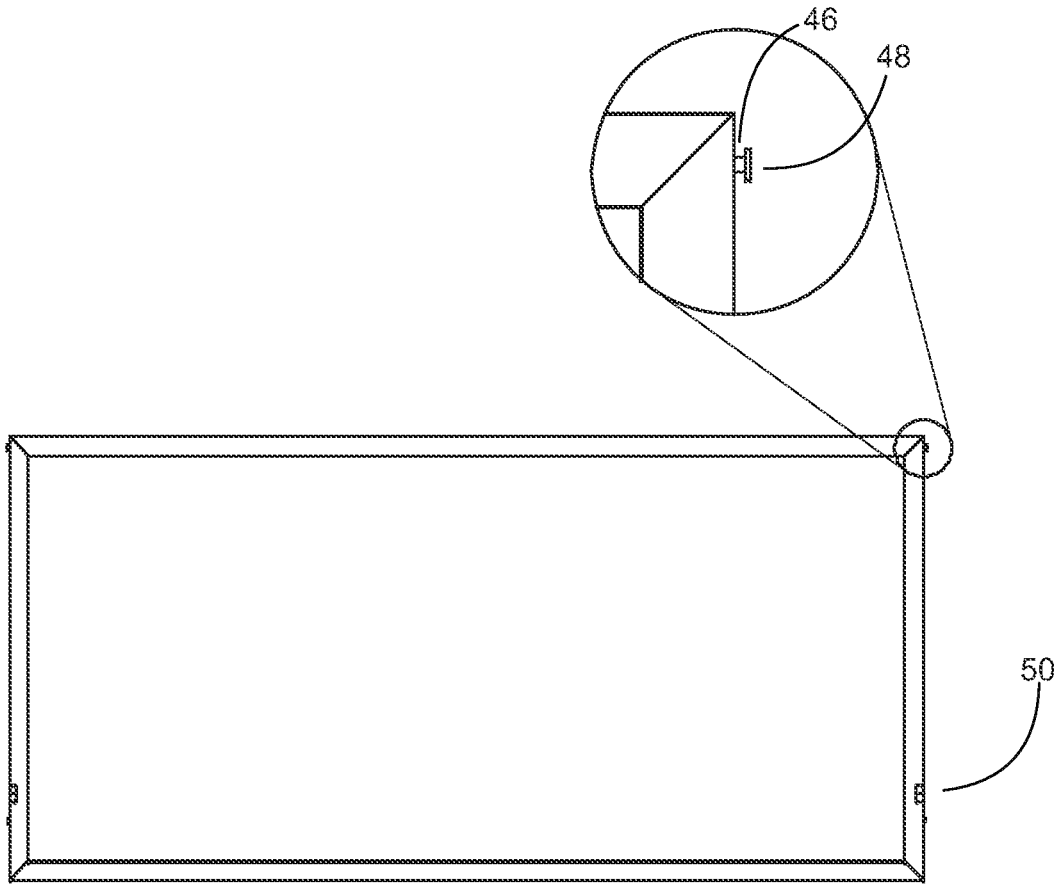
FIG. 9 is a diagram showing the panel pivot pin.

As seen in FIGS. 4 and 5, the LED panel 30 folds from a vertical position to a closed horizontal position. The T track frame is often called a T-bar frame 37 and can be existing structure. Also, the cover panel 21 can be existing structure to which the mounting bracket and LED panel are mounted to. The assembly begins by removing the existing lamps from the cover panel 21, then any ballast. The next step is to insert the bracket frame which includes the first mounting bracket 22 and the second mounting bracket 23. The mounting rails preferably have a tab and slot connection. After the mounting rails are inserted between the panel 21 and the T track frame, the LED panel 30 mounts to the mounting rails. The mounting brackets and mounting hole have an engagement which allows the user to first hang the LED panel 30 by inserting the panel pivot pin 46 into the panel pivot pin opening 47. The mounting brackets, mounting hole and panel connections to the mounting bracket frame are preferably all in the corners of the LED panel 30 on the left and right sides.

As seen in FIGS. 6 and 7, the pivot hook latch 33 has a pivot hook body 50 which is preferably flat and terminates at a pivot hook handle 51. The pivot hook handle 51 extends at an angle from the pivot hook body 50. The pivot hook tip 52 passes through the panel stop latch opening 53 and engages to it. A retainer slot 45 with a panel pivot opening 47 and a retainer slot low side 49 is preferably formed next to the panel stop latch opening 43 to allow for reversibility of the installation. Preferably, the first mounting bracket 22, and the second mounting bracket 23 both have a pair of panel stop latch openings 53 and a pair of retainer slots 45. For example, the first mounting bracket 22 may have a first mounting bracket front panel stop latch opening 53, and a first mounting bracket rear panel stop latch opening 53. The second mounting bracket 23 have a second mounting bracket front panel stop latch opening 53 and a second mounting bracket rear panel stop latch opening 53. Also, the first mounting bracket may have a first mounting bracket front retainer slot, and a first mounting bracket rear retainer slot. The second mounting bracket may have a second mounting bracket front retainer slot and a second mounting bracket rear retainer slot.

As seen in FIG. 8, the mounting brackets are U-shaped and have a pair of cutouts for the folded panel stops. The pivoting hook body 50 engages one of the folder panel stops. The U-shaped mounting bracket can be inserted first. The LED panel preferably has reversible installation, so that a user can remove the LED panel, rotate it 180° and reinstall it to the same bracket frame.

The invention claimed is:

1. A light troffer assembly comprising:

a cover panel;

a T-bar frame having a right T-bar parallel to a left T-bar, and with a rear T-bar parallel to a front T-bar;

a bracket frame mounted between the cover panel and the T-bar frame, wherein the bracket frame includes a first mounting bracket mounted above the right T-bar, a second mounting bracket mounted above the left T-bar, and a first mounting rail and a second mounting rail connecting the first mounting bracket to the second mounting bracket, wherein the mounting bracket frame is sandwiched between the cover panel and the T-bar frame;

an LED panel having an LED panel power supply, wherein the LED panel includes pivot hook latches and pivot pins; and a pair of first mounting bracket panel stops formed on the first mounting bracket and a pair of second mounting bracket panel stops formed on the second mounting bracket, wherein the pivot pins engage pivot pin openings on the first mounting rail and the second mounting rail, and wherein pivot hook latches engage one of the first mounting bracket pivot hook openings and one of the second mounting bracket panel pivot hook openings when the LED panel swings from a vertical disengaged position to a horizontal engaged position.

2. The light troffer assembly of claim 1, further comprising: a panel stop cut out formed adjacent to a panel stop bend, wherein the panel stop is bent towards the LED panel.

3. The light troffer assembly of claim 1, further comprising: panel pivot pin heads formed on the pivot pins.

4. The light troffer assembly of claim 1, wherein the first mounting panel pivot hook openings and the second mounting panel pivot hook openings are configured to provide reversible installation of the LED panel.

5. The light troffer assembly of claim 1, wherein the panel stops are folded at panel stop bends, wherein the panel stops are folded toward the LED panel.

6. The light troffer assembly of claim 1, wherein the first mounting bracket and the second mounting bracket have a mounting bracket main section and a pair of mounting bracket extensions that extends at a 90° angle from the mounting bracket main section.

7. The light troffer assembly of claim 1, wherein the panel stops have a planar section with an upward extending lip, wherein the panel stops abut an upper surface of the LED panel when the LED panel is rotated to an engaged horizontal position from a disengaged vertical position.

8. The light troffer assembly of claim 1, wherein the panel stop cut out is rectangular and elongated.

9. The light troffer assembly of claim 1, wherein the panel stop cut outs and the panel stop bends are parallel to retainer slots, and wherein the panel stop cut outs are rectangular and elongated.

10. The light troffer assembly of claim 1, wherein the pair of first mounting bracket panel stops and the pair of second mounting bracket panel stops are configured to provide reversible installation of the LED panel.

11. The light troffer assembly of claim 10, further comprising: a panel stop cut out formed adjacent to a panel stop bend, wherein the panel stop is bent towards the LED panel.

12. The light troffer assembly of claim 10, further comprising: panel pivot pin heads formed on the pivot pins.

13. The light troffer assembly of claim 10, wherein the first mounting panel pivot hook openings and the second mounting panel pivot hook openings are configured to provide reversible installation of the LED panel.

14. The light troffer assembly of claim 10, wherein the panel stops are folded at panel stop bends, wherein the panel stops are folded toward the LED panel.

15. The light troffer assembly of claim 10, wherein the first mounting bracket and the second mounting bracket have a mounting bracket main section and a pair of mounting bracket extensions that extends at a 90° angle from the mounting bracket main section.

16. The light troffer assembly of claim 10, wherein the panel stops have a planar section with an upward extending lip, wherein the panel stops abut an upper surface of the LED panel when the LED panel is rotated to an engaged horizontal position from a disengaged vertical position.

17. The light troffer assembly of claim 10, wherein the panel stop cut out is rectangular and elongated.

18. The light troffer assembly of claim 10, wherein the panel stop cut outs and the panel stop bends are parallel to retainer slots, and wherein the panel stop cut outs are rectangular and elongated.

* * * * *